United States Patent [19]

Lorenzo et al.

[11] 4,307,332

[45] Dec. 22, 1981

[54] ENERGY EFFICIENT REGULATED POWER SUPPLY SYSTEM

[75] Inventors: John L. Lorenzo, Southbury; Vincent G. Coppola, Branford, both of Conn.

[73] Assignee: Pitney Bowes Inc., Stamford, Conn.

[21] Appl. No.: 141,238

[22] Filed: Apr. 17, 1980

[51] Int. Cl.[3] ..... G05F 1/455

[52] U.S. Cl. ..... 323/246; 323/241; 363/86

[58] Field of Search ..... 323/235, 237, 239, 241, 323/244, 246, 901; 363/85, 86, 128; 307/252 T, 252 UA

[56] References Cited

U.S. PATENT DOCUMENTS

| | | | |
|---|---|---|---|
| 3,562,626 | 2/1971 | Morell | 363/86 |
| 3,890,562 | 6/1975 | West | 323/235 |
| 3,956,644 | 5/1976 | Zambre | 307/252 UA |
| 4,051,425 | 9/1977 | Smith | 323/237 |

*Primary Examiner*—William M. Shoop
*Assistant Examiner*—Peter S. Wong
*Attorney, Agent, or Firm*—David E. Pitchenik; William D. Soltow, Jr.; Albert W. Scribner

[57] ABSTRACT

A regulated power supply circuit includes a transformer having a primary winding and a secondary winding electromagnetically coupled by an iron core. A source of AC operating voltage is coupled to the primary winding of the transformer via an actuable switch means. A load circuit coupled to the secondary winding circuit is adapted to be energized by a voltage developed in the secondary winding circuit. Means are provided for sensing the polarity of each half cycle of said source of AC operating voltage. Memory means are coupled to the transformer for providing information representative of the polarity of each half cycle of the source of operating voltage applied to the primary winding of the transformer. The memory means are operable to maintain the information for a period of time when the switch is actuated to be opened. Means are also provided for sensing a parameter in the secondary winding circuit related to the energy available in the secondary winding circuit. Means couple the memory means, the AC operating voltage sensing means and the parameter sensing means to the actuable switch means.

13 Claims, 3 Drawing Figures

ENERGY EFFICIENT REGULATED POWER SUPPLY SYSTEM

FIELD OF THE INVENTION

The present invention relates to power supply systems having an iron core transformer, and more particularly, to energy efficient power supply systems adapted to be energized by a source of AC operating potential.

BACKGROUND OF THE INVENTION

In power supplies designed to provide a constant voltage to a load circuit, it is desirable to minimize heat dissipation and to reduce power consumption. These goals, however, for power supplies operated off an AC line, are constrained by the requirement that the power supply must function properly for the lowest AC line voltage condition in conjunction with the largest power demand by the load circuit.

When the AC line voltage applied to the input of the power supply increases, the power supply becomes inefficient in its use of power from the line. Power which is not required by the load circuit must be dissipated to maintain a constant load circuit voltage. The same holds true when the power demanded by the load circuit reduces. In this case also, to maintain the proper constant load circuit voltage, power which is not required must be dissipated to maintain the constant load circuit voltage.

Thus, the power supply operates at peak efficiency only for the lowest AC line voltage with largest load circuit power demand which the supply must service.

Power utilization inefficiency can become particularly severe because many power supplies must be designed to function during brown out conditions where the AC line voltage is reduced for extended periods of time. The inefficiency can also be severe where the load circuit power demands continually fluctuate as operating conditions in the load circuit vary. These varying load circuit power demands can, for example, involve operation of motors, solenoids and other power consuming components which may continuously cycle on and off.

SUMMARY OF THE INVENTION

It has been found that a precisely controlled switch coupled between the AC line and the power supply transformer primary winding can be operated to reduce power dissipation under the above varying conditions. The switch operates, as hereinafter explained, to switch the AC line voltage on and off, as required, to maintain a constant load circuit voltage without undue power consumption. The switching provides an additional form of regulation to regulation which may be provided in the transformer secondary winding circuit. The switching arrangement functions to reduce the power utilized from the AC line when sufficient power has already been supplied to and is stored in the secondary winding circuits.

The switching arrangement effectively disconnects the AC line when line power is not needed by the regulation circuit energized by the secondary winding. As a result, the line power is efficiently utilized by the regulated power supply system. The power applied to supply is controlled by the switching arrangement to accommodate varying load circuit and AC line voltage conditions. This efficient utilization of power from the AC line not only saves the cost of the power, but additionally, reduces the heat dissipation requirement on the power supply. This permits the selection of components having a lower heat dissipation rating, thereby reducing the cost of the components. Moreover, in certain instances, the need may be eliminated for components such as cooling fans and heat dissipation fins.

In a switching arrangement of the above type, conditions can occur which tend to drive the transformer iron core into saturation; that is, a condition where the magnetic induction of flux no longer increases with increases in the magnetic field intensity. If, during the operation of the power supply, the transformer iron core becomes saturated, excessive current may flow through the transformer's primary winding which can damage circuit components. As a result, it is necessary to operate the transformer such that the iron core is not driven into saturation.

If the switch in the transformer's primary winding circuit is actuated to first disconnect and thereafter connect the transformer to the AC line voltage, it is possible for the switch to be actuated such that it is turned off and thereafter turned on during similar polarity half cycles of the AC line voltage. Should this occur, the magnetic field intensity due to the flow of current through the primary winding will be in the same direction during the last half cycle of AC line voltage before turn off and during the first half cycle of AC line voltage after turn on. The cumulative effect of both half cycles can be sufficient to cause the iron core to saturate, with the attendant excessive current flow. Moreover, the switch may be actuated in a manner such that more than two half cycles of AC voltage of the same polarity are sequentially (although spaced in time) applied to the primary winding.

It has been found that by detecting the phase of the polarity of the last half cycle of AC line voltage applied to the transformer's primary winding before turn off and insuring that the opposite polarity half cycle of AC line voltage is applied as the next driving voltage after switch turn on, the magnetic field intensity will be in a direction to drive the magnetic field away from saturation.

Additionally, it is necessary that the switch turn off and turn on occur in a timed manner. This is to insure that even though the switch turn on and turn off are in opposite polarity half cycles, the cumulative effect does not drive the iron core into saturation. For example, if switch turn off occurs at the beginning of a half cycle of positive polarity voltage and switch turn on at the end of a half cycle of negative polarity voltage, the cumulative effects will be to apply slightly less than two successive half cycles of positive polarity voltage to the primary winding. This may be sufficient to drive the transformer's iron core into saturation.

In accordance with the present invention a regulated power supply circuit includes a transformer having a primary winding and a secondary winding electromagnetically coupled by an iron core. The iron core is of the type which can be driven into saturation. A source of AC operating voltage is coupled to the primary winding of the transformer via an actuable switch means. A load circuit is coupled to the secondary winding circuit and is adapted to be energized by a voltage developed in the secondary winding circuit. Means are provided for sensing the polarity of each half cycle of said source of AC operating voltage. Memory means are coupled to the transformer for providing information representative of the polarity of each half cycle of the source of operating voltage applied to the primary winding of the transformer. The memory means are operable to maintain the information for a period of time when the switch is actuated to be opened. Means are also provided for sensing a parameter in the secondary winding circuit related to the energy available in the secondary winding circuit. Means couple the memory means, the AC operating voltage sensing means and the parameter sensing means to the actuable switch means.

BRIEF DESCRIPTION OF THE FIGURES

A complete understanding of the present invention may be obtained from the following detailed description of a specific embodiment thereof, when taken in conjunction with the accompanying drawings, in which.

DETAILED DESCRIPION OF THE INVENTION

Figure 1:
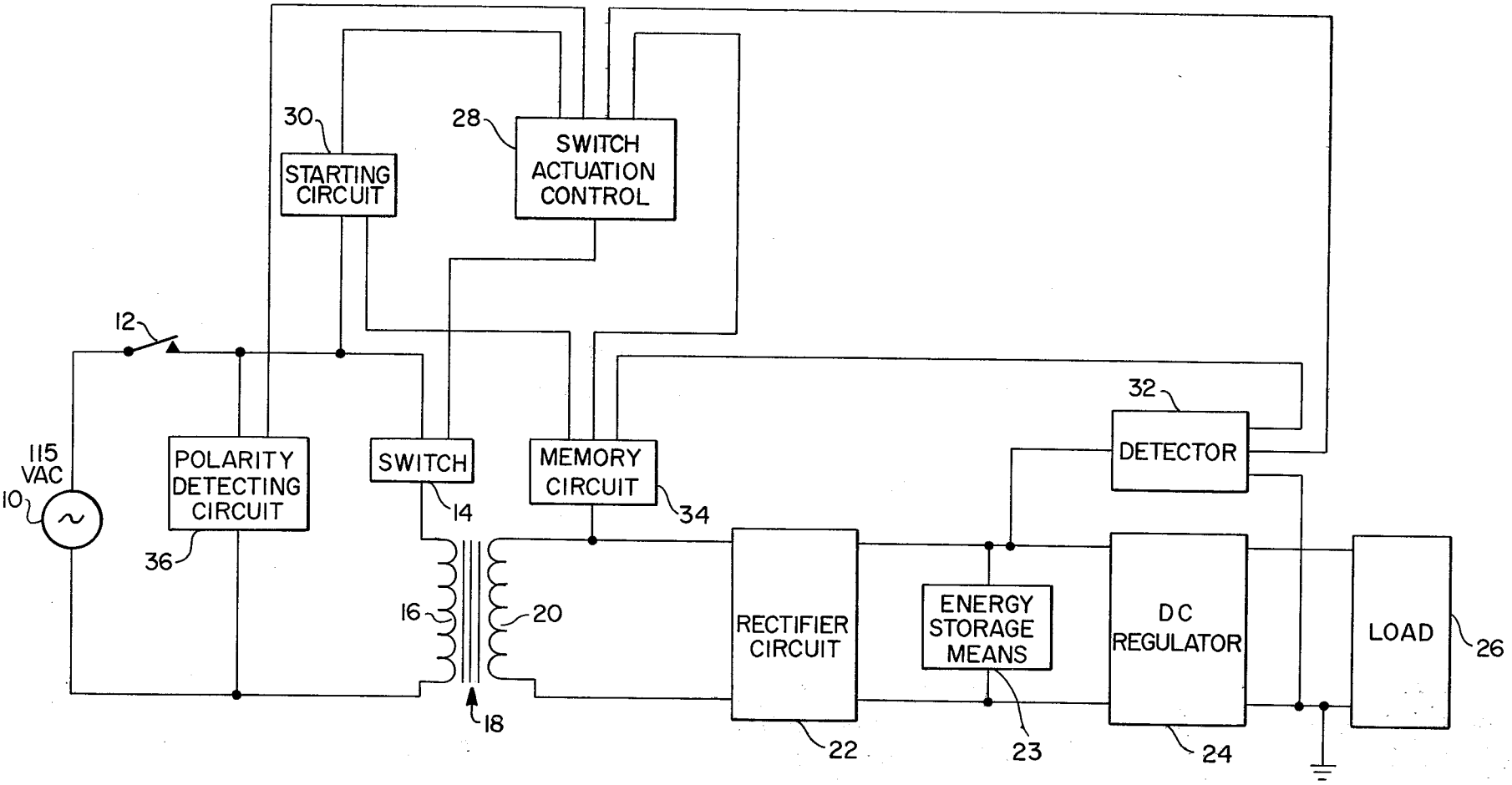
FIG. 1 is a block diagram of an energy efficient regulated power supply system embodying the present invention.
Figure 2:
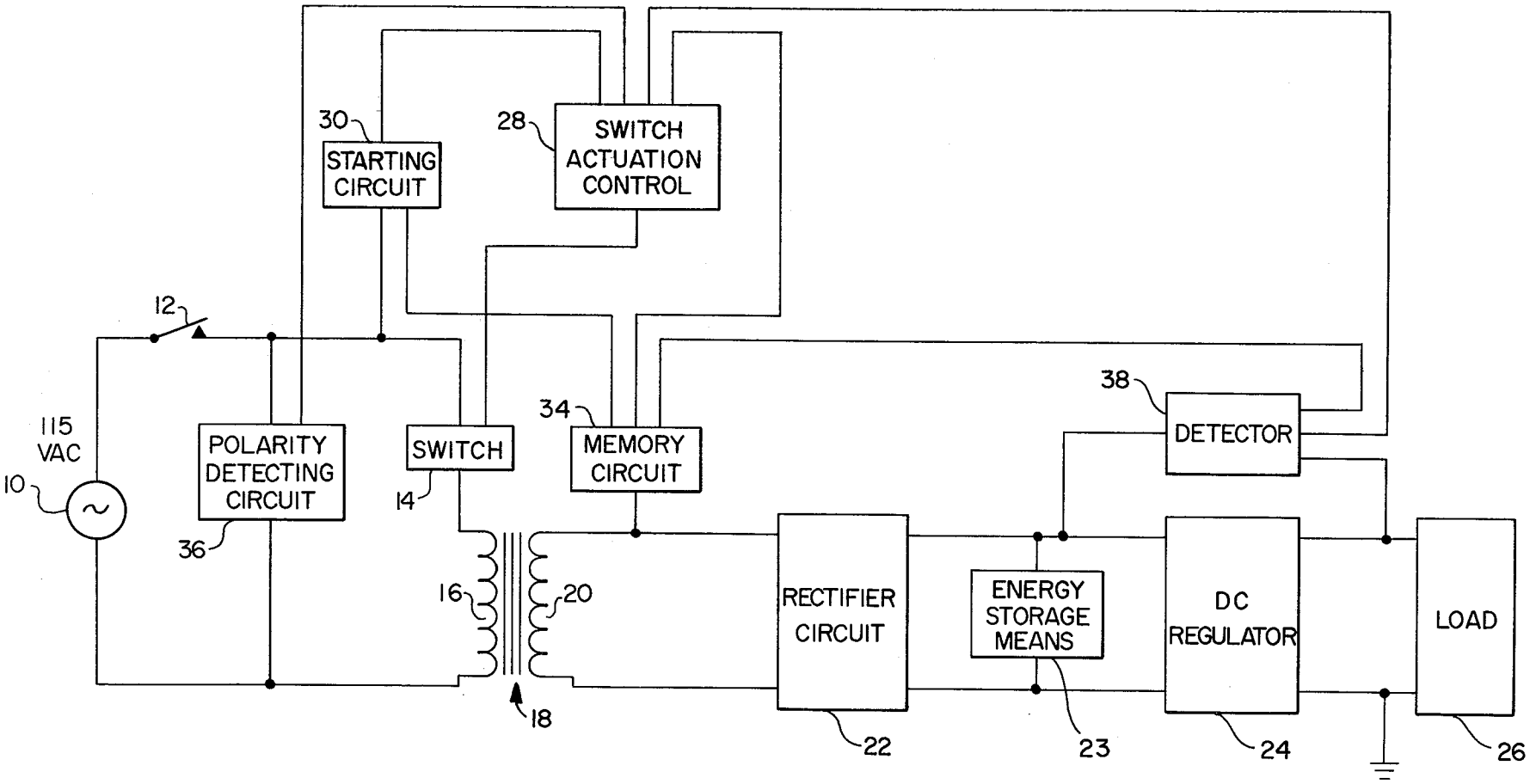
FIG. 2 is an alternate embodiment of the energy efficient regulated power supply system shown in FIG. 1.

Reference is now made to the power supply system shown in FIGS. 1 and 2 wherein similar reference numerals designate similar components. The function of the power supply system is to provide a constant DC voltage to a load circuit regardless of fluctuations in the level of the AC line or operating voltage, or variations in the power demand by load circuit in a manner which minimizes the AC line power utilized by the system.

A source of AC operating voltage 10 is applied via an ON/OFF power supply system switch 12 and a second solid state switch 14 across the primary winding 16 of an iron core transformer 18. The transformer is of the type wherein an iron core provides a low reluctance path for electromagnetic coupling between the primary winding 16 and a secondary winding 20. The core is of the type which can be driven into saturation by a series of successive half cycles of the same polarity voltage applied to the primary winding 16.

The secondary winding 20 is coupled to a rectifier circuit 22 to provide an unregulated DC output voltage which is applied to a DC regulator 24. Regulator 24 can be any of a large number of commonly available DC regulators such as series or shunt type regulators. A load circuit 26 is coupled to the output of DC regulator 24. The load circuit may be of the type which can vary during operation.

A switch actuation control circuit 28 controls the actuation of switch 14. The switch actuation control operates to bias switch 14 into and out of conduction in a manner which efficiently utilizes power from the source of AC operating potential 10. When the circuit is first brought into operation the ON/OFF system switch 12 is closed. This causes starting circuit 30 to provide an output signal to switch actuation control 28 to cause switch 14 to be biased into conduction. The AC voltage applied to the primary winding 16 is electromagnetically coupled via the iron core 18 to the secondary winding 20 where it is rectified in the rectifier circuit 22 providing a DC operating voltage for DC regulator 24.

As the voltage at the output of the rectifier circuit 22 begins to build, the voltage level is detected by detector 32 which is coupled between the output of the rectifier circuit 22 and ground. The detector 32 detects the level of voltage which is indicative of whether or not additional power is required from the AC source 10. Information relative to the detected voltage level is applied to switch actuation control 28. The output from the detector applied to the switch actuation control 28 provides information that additional power is required from the AC source 10 and switch 14 is maintained biased for conduction.

When the voltage builds to a predetermined level indicating a sufficient available power in energy storage means 23, detector 32 provides a signal to the switch actuation control 28 to cause switch 14 to be biased out of conduction. This information is additionally provided to a memory circuit 34. The memory circuit stores information relative to the polarity of the last half cycle of operating potential 10 applied to the primary winding 16 of transformer 18. The output from the memory circuit 34 is coupled to the switch actuation control 28.

The memory circuit 34 operates in conjunction with a polarity detecting circuit 36, which provides information as to the polarity of the half cycles of AC operating voltage from source 10. This controls the timing when the switch actuation control is operated to bias switch 14 into conduction when the detector circuit 32 indicates the need for additional power from the AC souce 10.

The switch 14 is controlled such that it is biased into conduction at a time when the polarity of the half cycle of AC operating voltage 10 is opposite to the polarity of the last half cycle when switch 14 was biased out of conduction. In this manner the primary winding 16 is not subject to a series of half cycles of AC voltage of the same polarity which may cause the iron core of transformer 18 to be driven into saturation.

Reference is now made to FIG. 2 which is an alternate embodiment of the energy efficient regulated power supply shown in FIG. 1. The various circuit components operate in a manner similar to FIG. 1. However, a detector in this embodiment, designated by reference numeral 38, is connected across the DC regulator 24. The detector detects the voltage difference between the unregulated DC voltage input signal to regulator 24 and the regulated DC voltage output signal from the regulator. The detector may be a differential type amplifier. This provides the advantage of providing detection where one of the detected parameters is the constant voltage level applied to the load 26. Consequently, detector 38 provides a more direct indication of variations between the unregulated and regulated DC voltages in the secondary winding 20 circuit.

Figure 3:
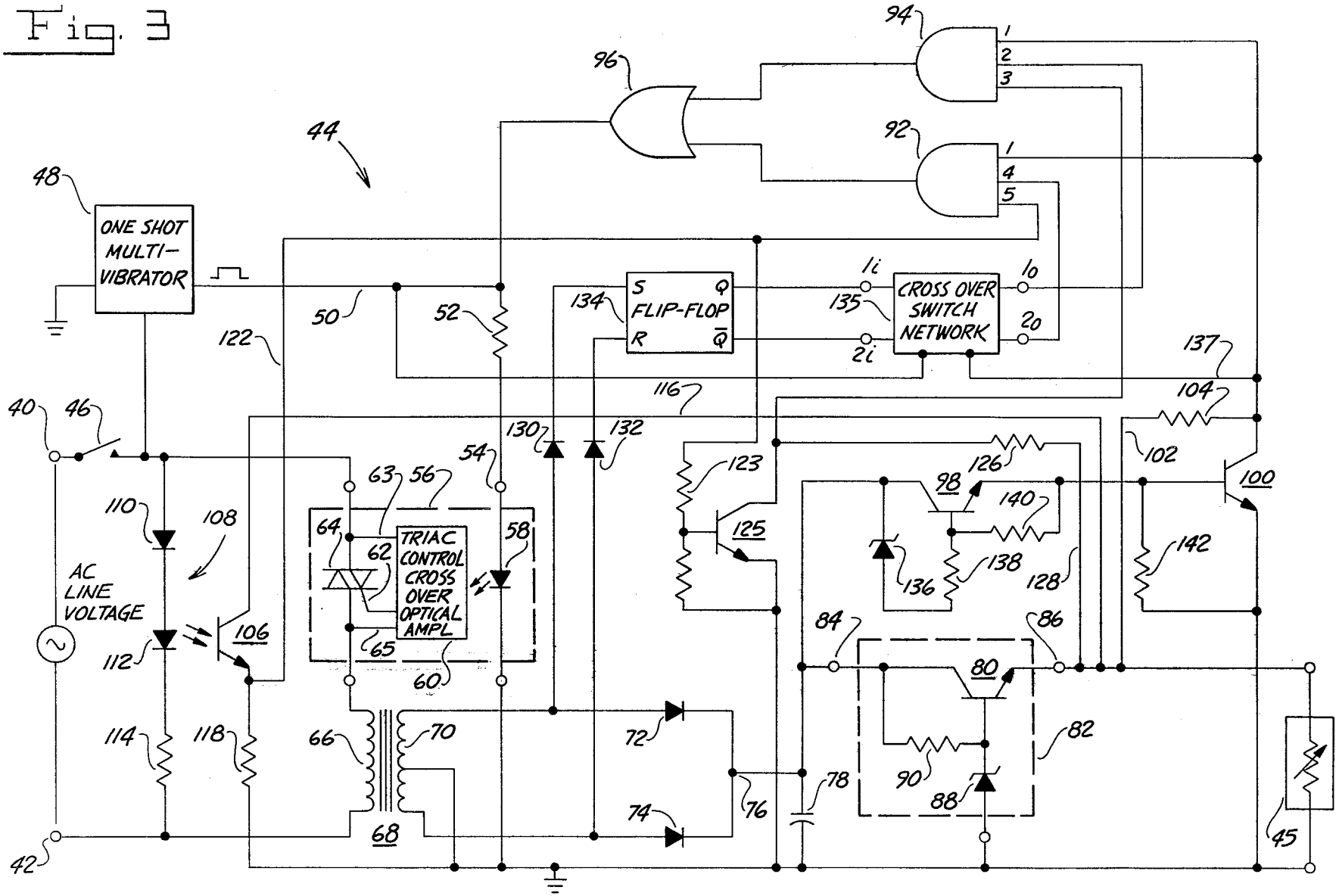
FIG. 3 is a schematic circuit diagram in accordance with the block diagram of FIG. 1.

Reference is now made to FIG. 3. A source of AC line voltage, such as a 60 Hertz 115 AC voltage, is applied across input terminals 40 and 42 of a regulated DC power supply system 44. The power supply system has an iron core transformer with voltage regulation provided by control of both the primary winding circuit and the secondary winding circuit. This enables a regulated DC output voltage for use in a load circuit 45 to be generated in a manner which conserves energy by controlling the amount of AC line power consumed.

When an ON/OFF power supply system switch 46 is actuated, the AC line voltage is applied to a one shot multivibrator 48 causing an output starting pulse to be developed on line 50. The output pulse is applied via reistor 52 to the control terminal 54 of a zero crossing type solid state relay 56. One suitable relay is a Teledyne Series 601 or Series 611 relay. Relays of this type are disclosed in the 1979 Teledyne Relay Data Book. The relays have a characteristic where the solid state switch turns on at near zero voltage and turns off at near zero current. These devices are four terminal devices with two terminals for the AC switch and two terminals for switch control. These switches can be actuated to close in a small fraction of time compared to a half cycle of AC line voltage, and open at zero current. Should it be desired, the one shot multivibrator 48 can be replaced by a modification to the ON/OFF switch 46 so that upon closure, the main AC terminals of relay 56 are shorted together to effect start up of the circuit.

The voltage pulse applied at the terminal 54 causes an LED 58 within the solid state relay 56 to illuminate. The illumination is detected by an optical detector zero cross amplifier 60 which applies a trigger signal to gate 62 of triac 64. The optical amplifier 60 is further connected by leads 63 and 65 across the main terminal of triac 64 to detect zero crossing voltage conditions.

It should be noted that many solid state AC switches are suitable for use in the present circuit. The requirement for such switch is that it turn on and off at definite points within a half cycle of AC line voltage and it has a sufficient fast response so that it can be turned on in a small fraction of time compared to a half cycle of AC line voltage.

When the triac 64 is biased for conduction, the AC line voltage across terminals 40 and 42 is applied via the switch 46 and the conducting triac 64 to the primary winding 66 of iron core transformer 68. An AC voltage is developed in the grounded center tap secondary windings 70 of the transformer. This voltage is full wave rectified by diodes 72 and 74. The unregulated DC voltage developed at junction 76 is applied to a large storage capacitor 78.

As the voltage begins to build at junction 76 an NPN transistor 80 in regulator 82 is biased into condition. Regulator 82 is adapted to be energized by an unregulated DC voltage at terminal 84 and provide a regulated DC output voltage at terminal 86. The regulated DC voltage developed at terminal 86 tracks the unregulated voltage at terminal 84 until the zener break down voltage of zener diode 88 is reached. At this time, the voltage at the base electrode of transistor 80 is clamped to the zener break down voltage level. A resistor 90 is coupled between the collector and base electrodes of transistor 80 to provide base drive and current limiting for the zener diode. The regulated DC voltage developed at terminal 86 is the zener break down voltage level less the base-emitter electrode voltage of transistor 80.

By the time the voltage applied to LED 58 from the one shot multivibrator 48 begins to decay, the circuit operates under control of AND gates 92 and 94 in conjunction with OR gate 96. These gates, in cooperation with other circuit components hereinafter described, function to keep the AC solid state switch 56 biased for conduction or enabled so long as the circuit coupled to the transformer's secondary winding demands power.

When power from the AC line is required, AND gates 92 and 94 are enabled on alternate half cycles of the AC line voltage to sequentially enable OR gate 96, thereby continuously biasing LED 58, and thus triac 64, into conduction on alternate half cycles.

As the voltage begins to build at both terminal 84 and terminal 86 (before regulation is achieved) the voltage at terminal 84 is insufficient to bias an NPN transistor 98 into conduction. As a result a second NPN transistor 100 connected to transistor 98 is biased out of conduction. At this time, the rising voltage at terminal 86 is applied via lead 102 and resistor 104 to both of the AND gates 92 and 94. This is designated as terminal 1 on both AND gates to show that the same voltage is applied to the terminals. Under this condition, the AND gates 92 and 94 will each be enabled if a positive voltage is applied to the remaining two input terminals.

A phototransistor 106 is connected to sense the polarity of each half cycle of the AC line voltage. This is achieved in conjunction with a circuit 108 connected across the input terminals 40 and 42. The circuit consists of an isolation diode 110 in series with an LED 112 and a current limiting resistor 114. On positive half cycles of the AC line voltage, the light emitting diode 112 is biased into conduction and the illumination from the diode biases phototransistor 106 for conduction. Power to operate phototransistor 106 is obtained from the voltage developed at terminal 86 via lead 116. The voltage developed across the resistor 118 is applied via line 122 to terminal 5 of AND gate 92, through resistor 123 and through an inverting transistor 125 to terminal 3 of AND gate 94. Thus, AND gate 92 has terminal 5 enabled with a high voltage when the AC line voltage half cycle is positive and disabled when the AC line voltage half cycle is negative. However, AND gate 94 operates in a complementary manner. Terminal 3 of AND gate 94 is enabled when the AC line voltage half cycle is negative and disabled when the AC line voltage half cycle is positive. The inverting NPN transistor 125 has its base electrode connected to the emitter electrode of transistor 106. The inverted output signal developed at the collector electrode is applied to terminal 3 of AND gate 94. Transistor 125 receives its operating voltage from the terminal 86 via a resistor 126 and lead 128.

The remaining input signals applied to terminal 2 of AND gates 94 and terminal 5 of AND gate 92 are from a memory circuit. The memory circuit provides information as to the polarity of the last half cycle of AC voltage developed in the secondary winding of transformer 70. However, it should be noted that the windings are such that the polarity of half cycles of AC voltage developed in the secondary winding 70 are in phase with and thus track the polarity of the half cycles of AC voltage developed in the primary winding 66. A 180° phase shift between the AC voltages developed in the primary and secondary winding can be accommodated by changing the inputs to the memory circuit. A cross over switch network 135 crosses the memory circuit output during start up of the circuit to synchronize the memory output with AC line half cycles.

The memory circuit includes two diodes 130 and 132 connected across opposite ends of the secondary circuit 70. These diodes provide input signals to a set (S) and a reset (R) terminal of a complementary output (Q, $\overline{Q}$) type flip flop 134. Diodes 130 and 132 can be supplemented by further wave shaping circuitry such as Schmitt trigger circuits to provide wave shaping, and edge definition should that be desired.

The flip flop 134 provides an output signal from terminal Q which is high when the polarity of the voltage developed at the anode of diode 130 is positive. The complementary output signal is developed at terminal $\overline{Q}$. The $\overline{Q}$ output signal is low when the output signal from terminal Q is high, and the output signal at terminal Q is low when the output signal at terminal $\overline{Q}$ is high. These output signals provide an indication of the polarity of the half cycle of AC voltage developed in the transformer's secondary winding circuit. The function of flip flop 134 and cross over switch network 135 will be described in greater detail hereinafter in connection with magnetic induction saturation prevention for transformer iron core 68.

Until the unregulated DC voltage at terminal 84 reaches its proper predetermined level, a positive or enabling voltage will be applied to terminals 1 of AND gates 92 and 94. Simultaneously, flip flop 34 will operate through cross over switch network 135 to apply a positive voltage to alternately enable terminals 2 and 4, respectively, of AND gates 94 and 92. At this time, a high or enabling voltage is also being alternately applied from transistor 106 and lead 122 to terminal 5 of AND gate 92. The inverse voltage is alternately applied to terminal 3 of AND gate 94.

Under this condition, the alternate enable signals on terminal 5 of AND gate 92 and terminal 3 of AND gate 94 is in synchronism with the enable signals applied to the AND gates from flip flop 134 via cross over switch network 135. The cross over switch network 135 under actuation by the output pulse from the one shot multivibrator pulse operates to cross switch the output signals of flip flop 134 such that cross over terminal li is connected to terminal 2o and terminal 2i is connected to terminal 1o. Consequently, AND gates 92 and 94 will alternately be enabled on opposite polarity half cycles of AC line voltage for output. This will be passed through the OR gate 96 and resistor 52 to maintain LED 58 biased for conduction thereby causing the solid state switch 64 to remain conductive.

When the voltage rises to a predetermined level at terminal 84, the voltage will cause zener diode 136 to reach its break down voltage level and current will be applied via the resistor 138 to the base electrode of transistor 98. This results in transistors 98 and 100 being biased into conduction. The input signal at terminals 1 of AND gates 92 and 94 are connected to ground through the collector-emitter electrode current path of transistor 100, causing the AND gates to be disabled. Resistors 140 and 142, respectively, provide a leakage current path for transistors 98 and 100. This insures that the transistors 98 and 100 are not improperly biased into conduction due to collector-base leakage current.

When transistor 100 becomes biased into conduction, the current flow through LED 58 ceases and triac 64 will turn off at the next zero crossing of AC line current. Additionally the grounding of lead 137 operates cross over switch network to be reset so that the connections are straight through the network. That is, terminals 1i-1o and 2i-2o are each respectively connected together. The voltage in the secondary winding 70 of transformer 68 falls to zero when turn off occurs. Nevertheless, flip flop 134 provides a memory as to the polarity of the last half cycle of AC voltage developed in the secondary winding 70. As a result, flip flop 134 will prevent the AND gates 92 and 94 being enabled when voltage is again needed, until the polarity developed in the primary circuit from the AC line voltage is opposite to the polarity last applied before turn off. Consequently, when the AC line is again connected, the current through primary winding 66 will be in a direction which tends to establish a flux in the iron core of transformer 68 in a direction which opposes saturation. This is because the magnetic force is in the opposite direction as the magnetic force which existed during the last half cycle before turn off. After the first half cycle of resumed operation, the cross over switch network reverts to the cross over connection mode. Under this condition, terminal 1i is connected to terminal 2o and terminal 2i is connected to terminal 1o. Thus, the alternate enable signals on terminal 5 of AND gate 92 and terminal 3 of AND gate 94 is in synchronism with enable signals applied to the AND gates from flip flop 134 via cross over switch network 135.

The circuit functions such that the regulator 82 provides a first form of regulation for the voltage to the load circuit coupled to terminal 86. The unregulated DC voltage level at terminal 84 is detected so that the AC line voltage can be disconnected from the primary winding circuit to eliminate unneeded power consumption if not required for maintaining the constant output voltage. This provides a second form of regulation, controlling the voltage developed at terminal 84 by turning on and off the power to the primary winding circuit. When the AC line voltage is again turned on, the timing is controlled so that the polarity of the half cycle is opposite in phase to when it was turned off. This helps prevent saturation of the iron core of transformer 68.

Many modifications can be made within the scope of the present invention. For example, the system of FIG. 1 can be modified to enhance the energy savings of the circuit by eliminating regulator 24. CMOS logic of the type that operates from approximately a 15 volt level down to a 3 volt level can control the system at, for example, an 8 volt nominal level without the use of the regulator coupled to the secondary winding of the transformer.

What is claimed is:

1. A regulated power supply system comprising:

a transformer having a primary winding and a secondary winding electromagnetically coupled by an iron core;

a source of AC operating voltages;

actuable switch means coupling said AC operating voltage to the primary winding of said transformer;

a circuit coupled to the secondary winding of said transformer;

means for sensing the polarity of each half cycle of said source of AC operating voltage;

memory means coupled to said transformer for providing information representative of the polarity of each half cycle of said source of AC operating voltage applied to the primary winding of said transformer, said memory means operable to maintain said polarity information for a period of time after said actuable switch means is actuated to electrically disconnect said AC operating voltage from the primary winding of said transformer;

means for sensing a parameter in said circuit coupled to the secondary winding of said transformer, said parameter related to the energy available in said circuit; and means coupling said memory means, said AC operating voltage sensing means and said parameter sensing means to said actuable switch means.

2. A power supply system as defined in claim 1 wherein said actuable switch is a solid state switch having a characteristic wherein said switch can be biased into and out of conduction at defined points in a half cycle of said AC operating voltage.

3. A power supply system as defined in claim 2 wherein said circuit coupled to the secondary winding of said transformer includes a DC regulator.

4. A regulated power supply system, comprising:

a transformer having a primary winding and a secondary winding electromagnetically coupled by an iron core;

a source of AC operating voltage;

an actuable switch operatively coupled to the primary winding of said transformer and said source of AC operating voltage such that said source of AC operating voltage is electrically connected to said primary winding when said switch is actuated to be in a first condition and said source of AC operating voltage is electrically disconnected from said primary winding when said switch is actuated to be in a second condition;

switch actuation means for actuating said switch to be in one of said first and said second conditions;

a circuit coupled to the secondary winding of said transformer;

detecting means coupled to said switch actuation means for detecting voltage levels in said circuit coupled to said secondary winding of said transformer for enabling said switch actuation means to be operable to actuate said switch to be in said first condition when a predetermined voltage level exists in said circuit;

memory means coupled to said transformer and to said switch actuation means for providing memory information representative of the polarity of each half cycle of said source of AC operating voltage applied to the primary winding of said transformer, said memory means operable to maintain said information when said switch actuation means is caused to actuate said switch in said second condition;

sensing means coupled to said switch actuation means for sensing the polarity of each half cycle of said source of AC operating voltage; and said switch actuation means operative to actuate said switch to be in said first condition only at a time when the polarity of the half cycle of said source of AC operating voltage is opposite to the polarity of the last half cycle of voltage of said source of AC operating voltage applied to the primary winding of said transformer.

5. A power supply system as defined in claim 4 including a starting circuit and an ON/OFF system switch coupled to said starting circuit, said starting circuit operable to effectuate start up of said power supply system when said ON/OFF switch is actuated to be in its ON state.

6. A power supply system as defined in claim 4 wherein said electrical parameter is a voltage level in said transformer secondary winding circuit.

7. A power supply system as defined in claim 6 wherein said transformer secondary winding circuit includes rectifier means for providing a DC voltage.

8. A power supply system as defined in claim 7 wherein said transformer secondary winding circuit further includes a DC regulator coupled to said rectifier circuit for providing a regulated DC voltage output.

9. A power supply system as defined in claim 8 wherein said electrical parameter voltage level is a voltage level at the input to said DC regulator.

10. A power supply system as defined in claim 8 wherein said electrical parameter is a voltage differential between the input voltage to said DC regulator and the output voltage from said DC regulator.

11. A regulated power supply system, comprising:

a transformer having a primary winding and a secondary winding electromagnetically coupled by an iron core;

a set of terminals adapted to be coupled to a source of AC operating voltage;

a solid state switch electrically coupled between said pair of terminals and the primary winding of said transformer;

a rectifier circuit means coupled to the secondary circuit of said transformer for rectifying the alternating voltage developed in the secondary winding when said primary winding is energized by said AC operating voltage;

regulator circuit means having an input coupled to said rectifier circuit and an output adapted to provide a constant DC voltage for a load circuit;

switch actuation means for actuating said AC switch to electrically connect and electrically disconnect the primary winding of said transformer from said source of AC operating voltage;

memory means including a flip flop circuit coupled to said transformer to provide an output signal representative of the polarity of each half cycle of said source of AC operating voltage, said flip flop operable to maintain said output signal when said AC switch is actuated to electrically disconnect the primary winding of said transformer from said source of AC operating voltage;

means coupled to said pair of terminals to provide signal information representing the polarity of the half cycle of said source of operating voltage;

detecting means coupled to said regulator circuit means for detecting a first predetermined voltage level and a second predetermined lower voltage level related to the energy available to energize said regulator circuit means; and means coupling said memory means, said detecting means, said AC operating voltage polarity sensing means to said switch actuation means such that said switch actuation means is controlled to actuate said switch to electrically connect the primary winding of said transformer to the source of AC operating voltage only at a time when the polarity of the half cycle of said operating voltage is opposite to the polarity of the last half cycle of the source of operating voltage when said switch was actuated to electrically disconnect the primary winding of said transformer from the source of AC operating voltage.

12. A power supply system comprising:

a transformer having a primary winding and a secondary winding electromagnetically coupled by an iron core;

a source of AC operating voltage, said operating voltage having alternate half cycles of positive and negative polarity whose amplitude and duration are such that a series of half cycles of the same polarity provides sufficient magnetic field intensity when said AC voltage is applied to the primary winding of said transformer to cause said iron core to magnetically saturate;

a solid state switch electrically coupled between the primary winding of said transformer and said source of AC operating voltage;

a diode rectifier circuit coupled to the secondary winding of said transformer;

a capacitor coupled to the diode rectifier;

a DC regulator having an input terminal coupled to said capacitor and an output terminal coupled to a variable type DC load circuit;

a memory circuit coupled to the secondary winding of said transformer;

a detector circuit for detecting the voltage level at the said capacitor;

means coupled to the source of AC operating voltage for sensing the polarity of each half cycle of said source of AC operating voltage;

a first three input terminal AND gate, means connecting the first terminal of said first AND gate to said detector means, means connecting the second terminal of said first AND gate to said memory circuit, means connecting the third terminal of said first AND gate to said AC operating voltage polarity detecting means;

a second three input terminal AND gate, means connecting said second AND gate first terminal to said detecting means, means connecting said second AND gate second terminal to said memory means, means connecting said AND gate third terminal to said AC operating voltage polarity detecting means;

a two input terminal OR gate, means connecting the output of said first and said second AND gates to the input terminals of said OR gate; and a switch actuation means operatively connected to the output of said OR gate to actuate said AC switch, to be biased into and out of conduction.

13. A power supply system as defined in claim 12 wherein the first terminal of said first and second AND gate are connected to be energized by the same signal information, and the second terminal of said first and said second AND gate are connected to be energized by complementary signal information, and the third input terminal of said first and said second AND gate are connected to be energized by complementary signal information.

* * * * *